US006402377B1

(12) United States Patent
Vo et al.

(10) Patent No.: US 6,402,377 B1
(45) Date of Patent: Jun. 11, 2002

(54) NON-BLOCKING ELASTOMERIC ARTICLES

(75) Inventors: Tin T. Vo, Canandaigua; Wayne J. Moras, Penfield; Steven P. Long, Canandaigua, all of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/576,574

(22) Filed: May 22, 2000

(51) Int. Cl.[7] ..... B65D 33/28

(52) U.S. Cl. ..... 383/75

(58) Field of Search ..... 383/75

(56) References Cited

U.S. PATENT DOCUMENTS

| | | | |
|---|---|---|---|
| 463,597 | A | 11/1891 | Cussen |
| 467,108 | A | 1/1892 | Cussen |
| 835,673 | A | 11/1906 | Fross |
| 916,802 | A | 3/1909 | Thompson |
| 1,092,955 | A | 4/1914 | Shaver |
| 1,095,790 | A | 5/1914 | Blumel |
| 1,751,473 | A | 3/1930 | Deubener |
| 2,125,758 | A | 8/1938 | Waters |
| 2,242,799 | A | 5/1941 | Moore |
| 2,254,510 | A | 9/1941 | Bergstein |
| 2,254,030 | A | 10/1941 | Allen |
| 2,280,601 | A | 4/1942 | Otter |
| 2,358,455 | A | 9/1944 | Hallman |
| 2,458,173 | A | 1/1949 | Kardon |
| 2,551,044 | A | 5/1951 | Ottinger et al. |
| 2,555,820 | A | 6/1951 | Satz |
| 2,609,317 | A | 9/1952 | Vogt |
| 2,635,510 | A | 4/1953 | Grant |
| 2,652,187 | A | 9/1953 | Steen et al. |
| 2,660,219 | A | 11/1953 | Haas et al. |
| 2,718,105 | A | 9/1955 | Ferguson et al. |
| 2,741,956 | A | 4/1956 | Diffenbaugh |
| 2,770,608 | A | 11/1956 | Barker et al. |
| 2,777,491 | A | 1/1957 | Ashton et al. |
| 2,883,913 | A | 4/1959 | Piazze |
| 2,886,085 | A | 5/1959 | Sanger |
| 2,893,468 | A | 7/1959 | Fieroh |
| 2,897,729 | A | 8/1959 | Ashton et al. |
| 2,958,365 | A | 11/1960 | Molins et al. |
| 2,971,874 | A | 2/1961 | Canno |
| 2,998,842 | A | 9/1961 | Good |
| 3,006,257 | A | 10/1961 | Orsini |
| 3,010,640 | A | 11/1961 | Kugler |
| 3,023,948 | A | 3/1962 | Hoeppner |
| 3,029,583 | A | 4/1962 | Patt |
| 3,029,853 | A | 4/1962 | Piazze |
| 3,058,402 | A | 10/1962 | Kugler |
| 3,058,403 | A | 10/1962 | Kugler |
| 3,077,295 | A | 2/1963 | Whiteford |
| 3,078,895 | A | 2/1963 | Silver |
| 3,119,549 | A | 1/1964 | Schoen |

(List continued on next page.)

FOREIGN PATENT DOCUMENTS

| | | |
|---|---|---|
| WO | WO 99/48681 | 9/1999 |

*Primary Examiner*—Stephen P. Garbe
(74) *Attorney, Agent, or Firm*—Jenkens & Gilchrist

(57) ABSTRACT

A drawtape bag comprising a pair of pliable thermoplastic body panels, a pliable drawtape and an elastomeric strip. The pair of pliable thermoplastic body panels are joined to each other along a pair of opposing sides and a bottom bridging the opposing sides. At least one of the body panels forms a hem extending along a mouth end disposed opposite the bottom. The hem includes one or more drawtape holes. The pliable drawtape is housed within the hem and includes a gathered section. The drawtape is partially exposed by the drawtape holes which allow the drawtape to be pulled therethrough to close the bag and to be used as a handle. The elastomeric strip is connected to the gathered section of the drawtape. The elastomeric strip comprises behenamide to inhibit or prevent blocking of the elastomeric strip to the hem or drawtape.

48 Claims, 6 Drawing Sheets

U.S. PATENT DOCUMENTS 3,285,309 A 11/1966 Northcott
3,406,610 A 10/1968 Golden
3,414,032 A 12/1968 Jortikka
3,418,891 A 12/1968 Rivman et al.
3,425,470 A 2/1969 Wuest
3,460,741 A 8/1969 Kugler
3,470,122 A 9/1969 Ridgeway et al.
3,474,058 A 10/1969 Ridgeway et al.
3,484,325 A 12/1969 Pendleton
3,506,048 A 4/1970 Jortikka
3,515,528 A 6/1970 Luther et al.
3,532,639 A 10/1970 Meyer
3,543,999 A 12/1970 Kugler
3,547,341 A 12/1970 Kirkpatrick
3,575,766 A 4/1971 McArthur et al.
3,592,379 A 7/1971 Nakamura
3,595,827 A 7/1971 Foster
3,597,382 A 8/1971 Foster
3,616,042 A 10/1971 Beyer et al.
3,652,474 A 3/1972 Berry et al.
3,687,357 A 8/1972 Hansen
3,738,568 A 6/1973 Ruda
3,746,682 A 7/1973 Watts
3,752,388 A 8/1973 Lynch
3,759,772 A 9/1973 Andersson
3,844,090 A 10/1974 Pepmeier
3,865,303 A 2/1975 Korn
3,891,587 A * 6/1975 Watts ..... 260/28.5 AV
3,909,330 A 9/1975 Schmermund
3,933,244 A 1/1976 Hughes et al.
3,935,048 A 1/1976 Rucker
3,969,304 A 7/1976 Pugh et al.
3,982,687 A 9/1976 Auer et al.
4,112,158 A 9/1978 Creekmore et al.
4,140,046 A 2/1979 Marbach
4,177,184 A 12/1979 Condon
4,180,490 A * 12/1979 Maclean ..... 260/23 R
4,202,721 A 5/1980 Roberts
4,210,244 A 7/1980 Westrick
4,260,003 A 4/1981 Hendrickson
4,299,324 A 11/1981 Dickens
4,349,104 A 9/1982 Hayes
4,354,335 A 10/1982 Meyer
4,360,398 A 11/1982 Sabee
4,380,446 A 4/1983 Dickson et al.
4,384,602 A 5/1983 Ores
4,397,704 A * 8/1983 Frick ..... 156/201
4,524,099 A 6/1985 Di Luccio
4,529,764 A 7/1985 McKinney et al.
4,547,237 A 10/1985 Hendrickson
4,558,463 A 12/1985 Boyd
4,574,134 A 3/1986 Willcox et al.
4,579,696 A 4/1986 Di Luccio
4,592,091 A 5/1986 Italici
4,597,750 A 7/1986 Boyd et al.
4,617,008 A 10/1986 Boyd et al.
4,624,654 A 11/1986 Boyd et al.
4,628,536 A 12/1986 Herrington
4,696,403 A 9/1987 Hoover
4,714,143 A 12/1987 Saliba
4,717,372 A 1/1988 Herrington
4,717,373 A 1/1988 Catchman et al.
4,721,501 A 1/1988 Herrington
4,721,502 A 1/1988 Herrington
4,746,391 A 5/1988 Heyse et al.
4,751,262 A 6/1988 McKinney et al.
4,759,467 A 7/1988 Byrne
4,762,430 A 8/1988 Bullard
4,768,818 A 9/1988 Kolic
4,769,126 A 9/1988 Roen et al.
4,778,283 A 10/1988 Osborn
4,786,189 A 11/1988 Broderick et al.
4,786,191 A 11/1988 Broderick et al.
4,786,275 A 11/1988 Hoover
4,792,241 A 12/1988 Broderick et al.
4,802,582 A 2/1989 Johnson
4,813,792 A 3/1989 Belmont et al.
4,813,793 A 3/1989 Belmont et al.
4,813,794 A 3/1989 Herrington
4,822,437 A 4/1989 Bryniarski et al.
4,832,507 A 5/1989 Herrington
4,832,677 A 5/1989 Hudgens et al.
4,842,420 A 6/1989 DiBiasi et al.
4,842,421 A 6/1989 Bullard et al.
4,850,946 A 7/1989 Broderick et al.
4,851,478 A 7/1989 Su
4,867,735 A 9/1989 Wogelius
4,872,766 A 10/1989 Dancy
4,880,316 A 11/1989 Belmont et al.
4,889,522 A 12/1989 Gietman, Jr.
4,895,611 A 1/1990 Bryniarski et al.
4,897,437 A 1/1990 McKinney et al.
4,930,905 A 6/1990 Sharps, Jr.
4,997,612 A 3/1991 Gianchandai et al.
5,040,902 A 8/1991 Eaton et al.
5,120,138 A 6/1992 Midgley et al.
5,133,607 A 7/1992 Bonke
5,265,961 A 11/1993 Boyd
5,449,711 A 9/1995 Saito et al.
5,925,454 A * 7/1999 Bekele ..... 428/324
5,972,519 A 10/1999 Niessner et al.
5,985,426 A * 11/1999 Wilkie ..... 428/215
6,059,458 A * 5/2000 Belias et al. ..... 383/75

* cited by examiner

NON-BLOCKING ELASTOMERIC ARTICLES

FIELD OF THE INVENTION

The present invention relates generally to plastic packages and, more particularly, relates to a drawtape bag having a strip that has reduced blocking to itself as well as other surfaces.

BACKGROUND OF THE INVENTION

Sealable polymeric packages, such as trash bags, are a common household item. The bags come to the consumer in the form of a roll of interconnected bags or as pre-separated bags housed in a dispensing box. When the bags are provided in the form of a roll, one end of the bag, the bottom, is thermally sealed closed and connected to its neighboring bag along a perforated line; the other end of the bag, the open mouth end, is attached to its neighboring bag solely along another perforated line. When the bags are pre-separated, neighboring bags are generally overlapped or interweaved in such a manner that removal of one bag from the dispensing box draws the neighboring bag toward an opening in the box.

To close a typical polymeric bag after it has been filled by the consumer, the bag body adjacent the open mouth end of the bag is gathered and tied into a knot or secured using a separate tie member supplied by the vendor of the bags. Tie members typically include paper coated flexible wires, rubber bands, or strips of plastic having a locking mechanism to provide a means to pull tight and securely fasten the neck of the bag. The need for separate tie members, however, adds an additional cost factor for the manufacturer, and ultimately, the consumer. In addition, separate tie members are easily lost and hence can be a nuisance for the consumer. Polymeric packages having integral closure systems overcome these problems. Such integral closure systems can be in the form of tie members, adhesives and the like.

One particularly advantageous closure system is a drawtape or drawstring that is integral to the bag body. Bags of this type are typically in the form of a pair of pliable thermoplastic body panels joined to each other along a pair of opposing sides and a bottom bridging the opposing sides. The bag may be opened along a mouth end formed opposite the bottom. The body panels form a hem along the mouth end of the bag, and the hem houses a pliable thermoplastic drawtape. One or more drawtape holes located within the hem expose the drawtape allowing it to be pulled through the holes to close the bag and to be used as a handle.

When consumers use a drawtape bag as a liner for a trash container, the bag body is inserted into the trash container such that the bag body generally extends downward into the trash container. The mouth end of the bag, including the hem, is drawn over and loosely mounted around an upper portion of the trash container. A shortcoming of such drawtape bags has been that the mouth end of the bag might fall back into the trash container, especially when consumers discard trash into the bag. This can be a nuisance for the consumer, who must then lift the mouth end of the bag out of the trash container and around the upper portion thereof. If the consumer does not notice that the mouth end of the bag has fallen into the trash container, the consumer might discard trash that is not captured by the drawtape bag but rather contacts and possibly sullies the inside wall of the trash container. This defeats the purpose of the bag, which is to serve as a liner for the trash container.

The use of some materials in forming the bag may also result in a condition termed blocking. Blocking is the undesired adhesion between layers of plastic materials in contact with each other. Blocking may prevent or inhibit portions of the bag from being able to move freely against another surface, such as the drawtape in a hem of a bag. Blocking may be caused by tacky materials or static electricity and may be exacerbated by higher temperatures and pressures. Higher temperatures and/or pressures are commonly encountered in hot warehouses. These warehouses may store material to be used in the bags, as well as storing the drawtape bags in boxes that are stacked. Winding tends to induce even higher pressures between the layers of film since polymers are extensible and the winding tension creates pressure in the roll.

Therefore, a need exists for a drawtape bag that overcomes the above-noted problems.

SUMMARY OF THE INVENTION

According to one embodiment, a drawtape bag comprises a pair of pliable thermoplastic body panels, a pliable drawtape and an elastomeric strip. The pair of liable thermoplastic body panels are joined to each other along a pair of opposing sides and a bottom bridging the opposing sides. At least one of the body panels forms a hem extending along a mouth end disposed opposite the bottom. The hem includes one or more drawtape holes. The pliable drawtape is housed within the hem and includes a gathered section. The drawtape is partially exposed by the drawtape holes which allow the drawtape to be pulled therethrough to close the bag and to be used as a handle. The elastomeric strip is connected to the gathered section of the drawtape. The elastomeric strip comprises behenamide.

According to another embodiment, a drawtape bag includes a pair of thermoplastic body panels, a pair of pliable drawtapes and a pair of elastomeric strips. The pair of pliable thermoplastic body panels are joined to each other along a pair of opposing sides and a bottom bridging the opposing sides. The body panels form respective hems extending along a mouth end disposed opposite the bottom. Each of the hems includes one or more drawtape holes. The pair of pliable drawtapes is housed within the respective hems. Each of the drawtapes includes a gathered section. Each of the drawtapes is partially exposed by the respective drawtape holes which allow the respective drawtape to be pulled therethrough to close the bag and to be used as a handle. The pair of elastomeric strips is connected to the gathered section of the respective drawtapes. Each of the elastomeric strips comprises behenamide.

According to a further embodiment, a drawtape bag comprises at least one pliable thermoplastic body panel, a pliable drawtape and an elastomeric strip. At least one pliable thermoplastic body panel has a top and bottom portion. At least one body panel forms a hem extending along the top portion opposite of the bottom portion. The hem includes one or more drawtape holes. The pliable drawtape is housed within the hem and includes a gathered section. The drawtape is partially exposed by the drawtape holes which allow the drawtape to be pulled therethrough to close the bag and to be used as a handle. The elastomeric strip is connected to the gathered section of the drawtape and comprises behenamide.

According to yet another embodiment, an article comprises at least one pliable thermoplastic body panel and an elastomeric strip. The at least one pliable thermoplastic body panel has a top and bottom portion, and forms a hem extending along the top portion opposite of the bottom portion. The elastomeric strip comprises behenamide and is housed within the hem.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
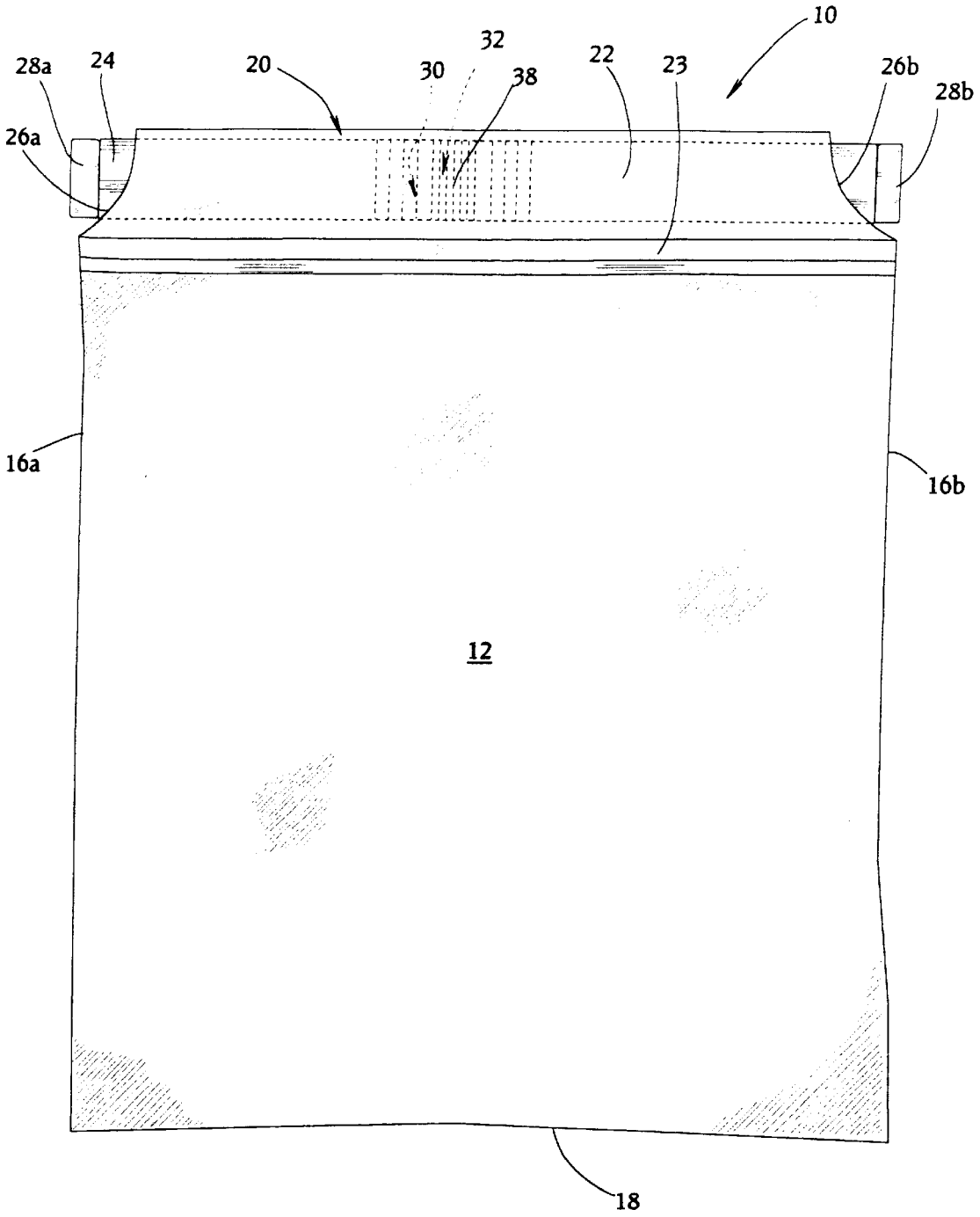
FIG. 1 is a side view of a drawtape bag with elastic top feature according to one embodiment of the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 illustrates a drawtape bag 10 comprising a pair of pliable thermoplastic body panels 12 and 14 (panel 14 is hidden beneath panel 12 in FIG. 1, but can be seen in FIG. 4) joined to each other along a pair of opposing sides 16*a* and 16*b* and a bottom 18 bridging the opposing sides 16*a* and 16*b*. The bag 10 may be opened along a mouth end 20 formed opposite the bottom 18. Each of the body panels 12 and 14 forms a respective hem 22 along the mouth end 20 of the bag 10. The hem 22 on each panel 12 and 14 houses a respective pliable thermoplastic drawtape 24. To maintain the drawtape 24 within the hem 22, the hem 22 is thermally sealed to the respective panel 12 and 14 along a respective hem seal 23.

Figure 5:
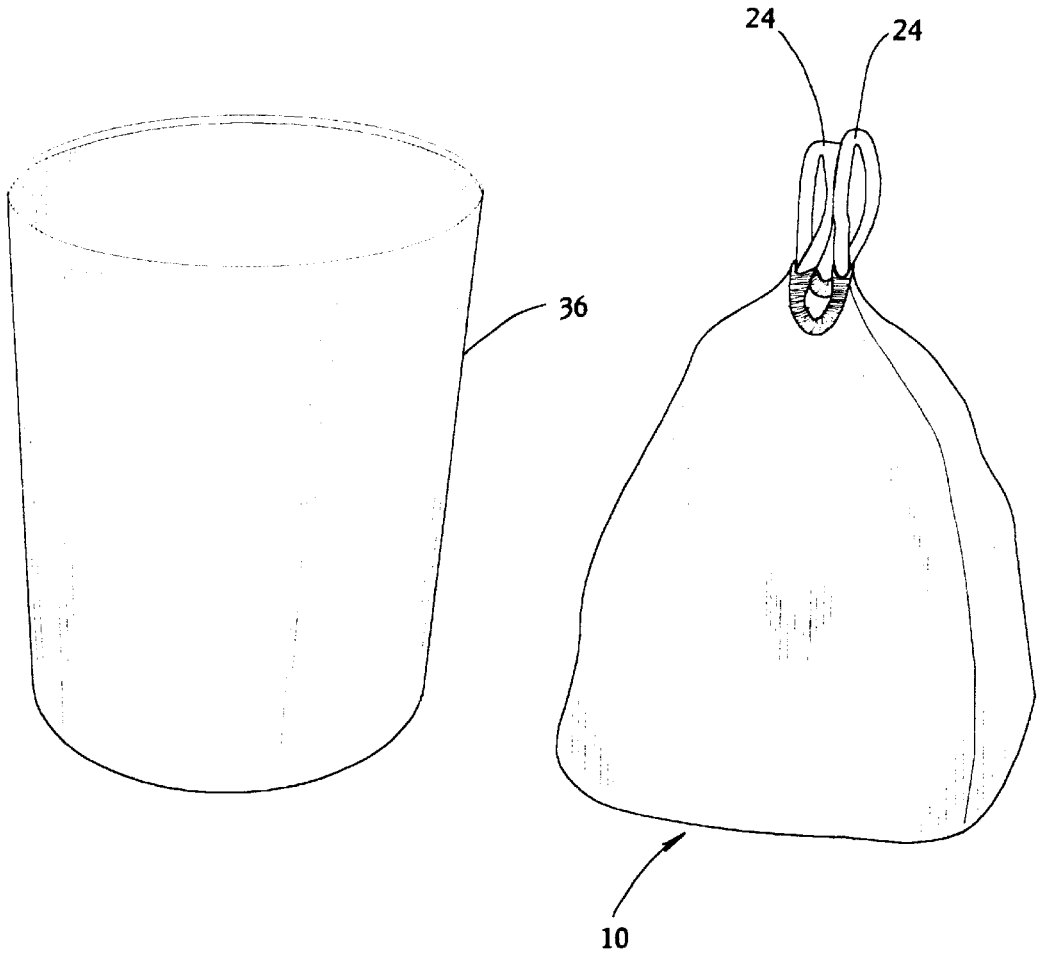
FIG. 5 is an isometric view of the drawtape bag of FIG. 1 removed from the trash container and closed using its drawtapes.

A pair of drawtape holes 26*a* and 26*b* are located in the hem 22 on each panel 12 and 14 at the respective sides 16*a* and 16*b*. The drawtape holes 26*a* and 26*b* in the hem 22 on the panel 12 coincide with the respective drawtape holes 26*a* and 26*b* in the hem on the other panel 14. The drawtape 24 housed within the hem 22 on the panel 12 is thermally sealed to the drawtape housed within the hem on the panel 14 at seals 28*a* and 28*b* coinciding with the respective drawtape holes 26*a* and 26*b*. The drawtape holes 26*a* and 26*b* provide a heat sealing bar with access to the drawtapes 24 for generating the drawtape seals 28*a* and 28*b*. Furthermore, when the drawtapes 24 are fully installed into the bag 10, the holes 26*a* and 26*b* expose the drawtapes 24 allowing them to be pulled through the holes 26*a* and 26*b* to close the bag and to be used as a handle as depicted in FIG. 5.

Figure 2:
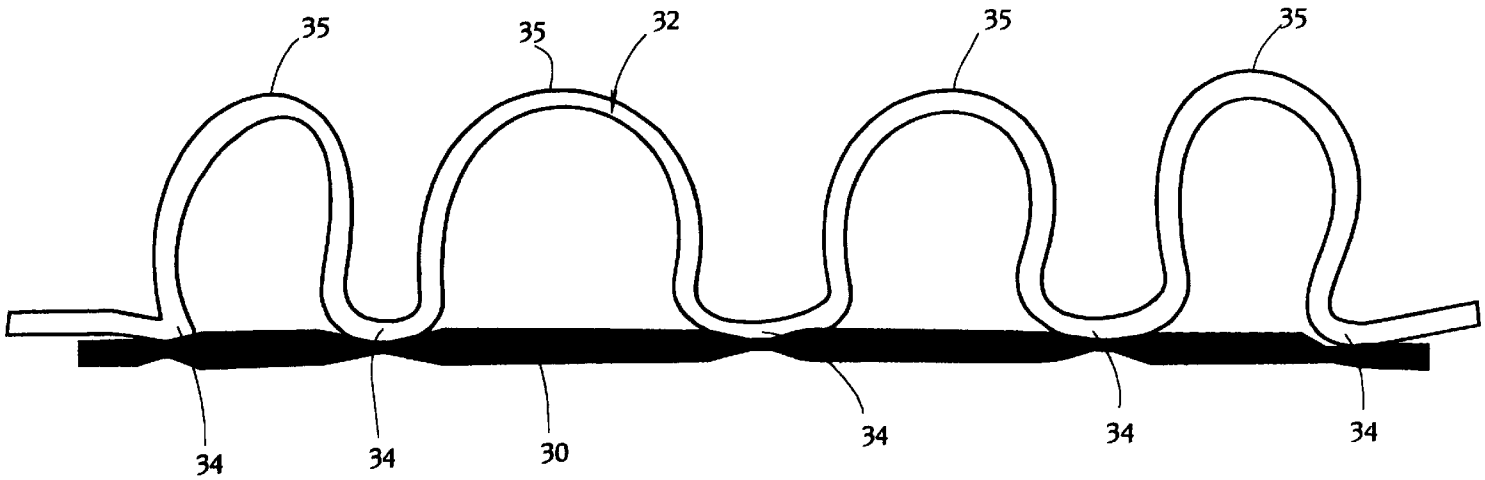
FIG. 2 is a cross-sectional view of an elastomeric strip attached to a looped section of a drawtape used in the drawtape bag, where the elastomeric strip is shown in unstretched form.

The drawtape bag 10 includes an elastic top feature that enables the bag 10 to be securely fitted to the upper portion of a trash container lined with the bag 10 and, at the same time, does not interfere with the intrinsic strength and operation of the drawtape 24. The elastic top feature is provided by an elastomeric strip 30 connected to a gathered section 32 of the drawtape 24 housed within the hem 22 on each panel 12 and 14. Specifically, the gathered section 32 is gathered into a plurality of loops defining a series of crests 35 and troughs 34, and each trough is thermally sealed to the elastomeric strip 30. This is best shown in FIG. 2, which is a cross-sectional view depicting the elastomeric strip 30 attached to the gathered section 32 at the troughs 34. The elastomeric strip 30 has a total length of less than the length of the drawtape 24 and preferably about equal in dimension to the footprint of the gathered section 32. The footprint of the gathered section 32 may be defined as the horizontal distance between the leftmost trough 34 and the rightmost trough 34 as viewed in FIG. 2.

Referring back to FIG. 1, the drawtape 24 is sealed in four specific locations along the mouth end 20 of the bag 10. The drawtape seals 28*a* and 28*b* referenced above are two of these sealed locations. Third and fourth sealed locations are provided by an anchor seal 38 found in the center of the hem 22 on each panel 12 and 14. The anchor seal 38 unitizes the drawtape 24 with adjacent layers of the hem 22.

Figure 4:
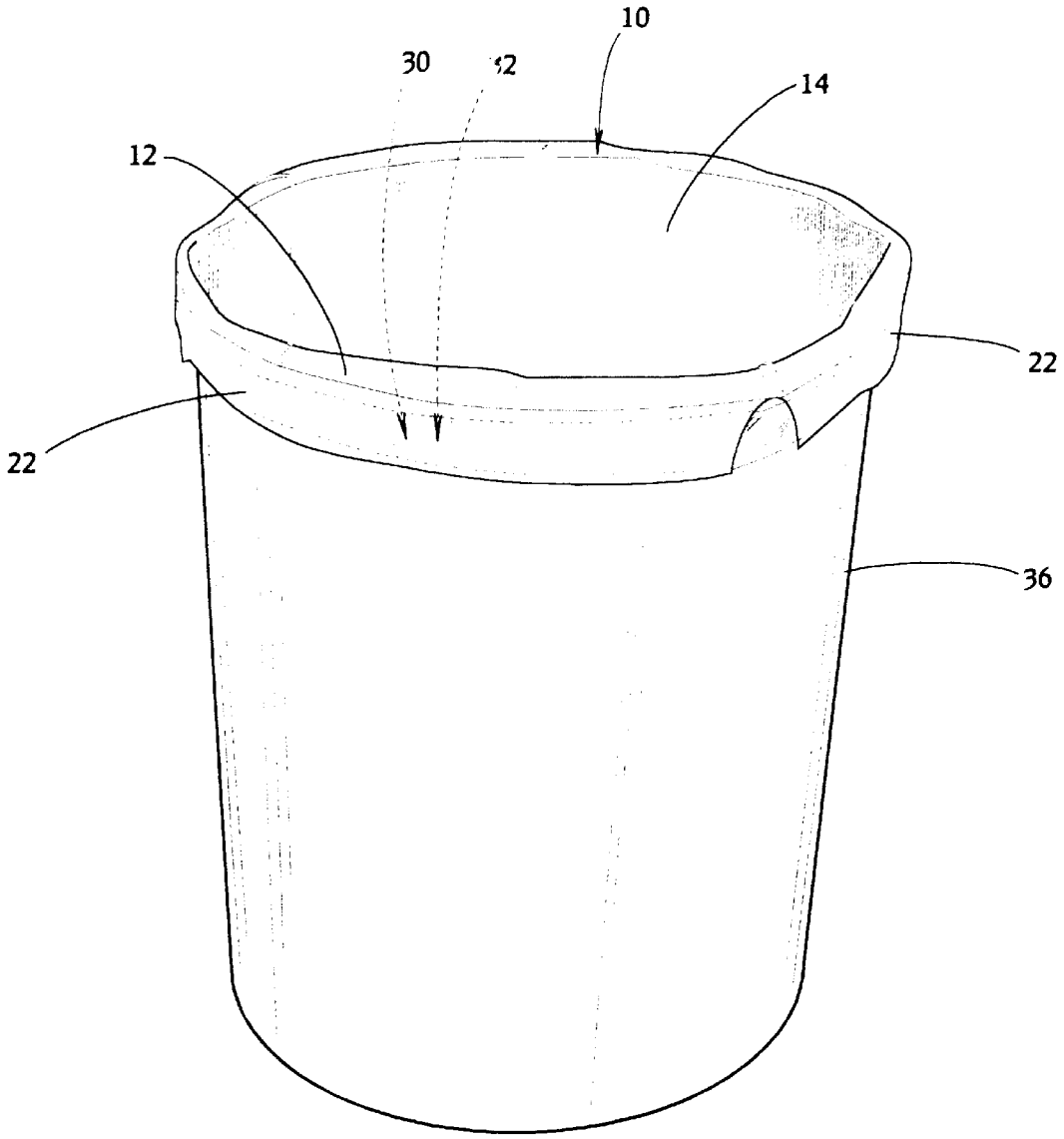
FIG. 4 is an isometric view of the drawtape bag of FIG. 1 securely mounted to a trash container.

Referring to FIG. 4, the drawtape 24 allows the mouth end of the drawtape bag 10, including the hems 22, to be drawn over and securely mounted around an upper portion of a trash container 36. Depending upon the size of the trash container 36, mounting the bag 10 to the container 36 stretches the elastomeric strip 30, thereby increasing the "wavelength" of each loop in the gathered section 32 and decreasing the height of the crests 35.

Figure 3:
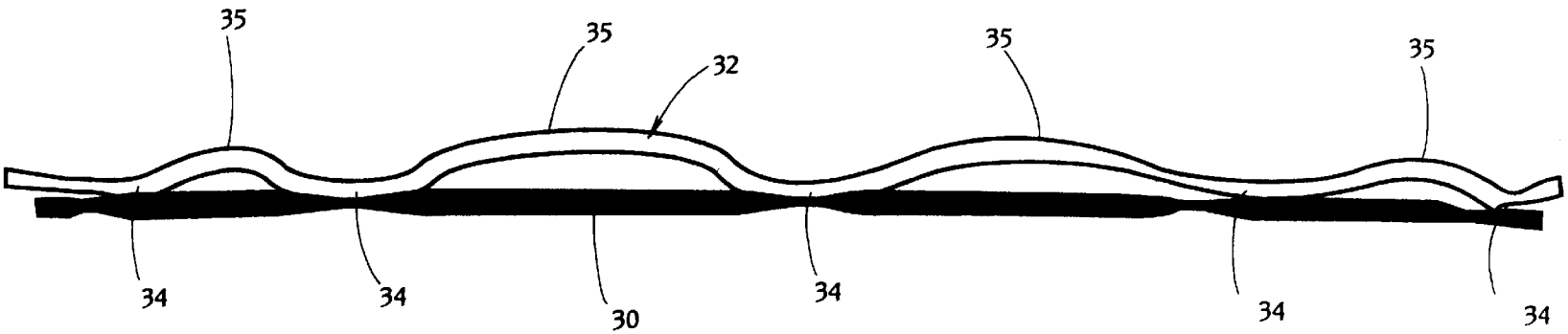
FIG. 3 is a cross-sectional view of the elastomeric strip attached to the looped drawtape section, where the elastomeric strip is shown in partially stretched form.

FIG. 3 is a cross-sectional view of the elastomeric strip 30 attached to the gathered section 32, where the elastomeric strip 30 is shown in partially stretched form. The elastomeric strip 30 can be stretched up to the point where the length of the stretched elastomeric strip 30 equals the length of the drawtape making up the gathered section 32, i.e., where the "wavelength" of each loop reaches a maximum and the height of the crests 35 reaches zero. Beyond that point, the tensile characteristics of the non-elastic drawtape 24 control the behavior of the two component construction, one component being provided by the drawtape 24 and the other component being provided by the elastomeric strip 30. The two component construction effectively combines the elastic behavior of the elastomeric strip 30 with the strength characteristics of the non-elastic drawtape 24. The elastomeric strip 30 enables the bag 10 to be securely fitted to the upper portion of a trash container lined with the bag 10.

The elastomeric strip 30 also comprises behenamide that assists in inhibiting or preventing blocking of the elastomeric strip to itself and other films. For example, the elastomeric strip 30 with behenamide inhibits or prevents blocking of the strip 30 to the draw tape 24 and the hem 22 of the drawtape bag 10. The addition of behenamide to the elastomeric strip 30 also inhibits or prevents blocking to itself when being wound as a roll. The elastomeric strip 30 of the present invention preferably does not stick to itself or to surfaces of other films (e.g., polyethylene) at room and elevated temperatures.

The elastomeric strip 30 is comprised of a polymeric material and has a low yield strength and high elasticity as compared to the respective yield strength and elasticity of a polyethylene drawtape 24. One type of elastomer is a material that at room temperature may be stretched at least a few times to about twice its original length and, then upon release of the stress, return with force to its approximate original length. In general, elastomers generally are more extensible than conventional polyethylene films, such as low density polyethylenes (LDPEs), high density polyethylenes (HDPEs) and linear low density polyethylenes (LLDPEs).

The elastomeric strips of the present invention are typically made from polyolefinic material having elastic properties. The elastomeric strips may be made from materials such as styrene butadiene copolymers (SBCs) and ethylene-propylene diene monomers (EDPMs), which are also referred to as terpolymer elastomers. The elastomers may be ethylene based, such as an elastomeric polyethylene. The ethylene based elastomers typically have a high level of comonomer such as hexene or octene. The ethylene based elastomers generally have a density from about 0.800 g/cm$^3$ to about 0.915 g/cm$^3$, and more typically from about 0.870 g/cm$^3$ to about 0.905 g/cm$^3$.

Other contemplated elastomers include the following: acrylonitrile-chloroprene copolymers; acrylonitrile-isoprene copolymers; butadiene-acrylonitrile copolymers; chlorinated polyethylenes; chlorosulfonated polyethylenes; ethylene ether polysulfides; ethylene-ethyl acrylate copolymers; ethylene polysulfides; ethylene-propylene copolymers; fluoroelastomers; fluorosilicones; hexafluoropropylene-vinylidene fluoride copolymers; isobutene-isoprene copolymers; organopolysiloxanes; acrylic ester-butadiene copolymers; polybutadienes; polychloroprenes; polyepichlorohydrins; polyisobutenes; polyisoprenes; polyurethanes; polyethylene-butyl graft copolymers; and styrene-butadiene-styrene triblock polymers.

In general, the tendency of polyolefins to block is related to density. Lower density polyolefins generally tend to block more severely than higher density polyolefins. Elastomers are one of the lowest density polyolefins available, and thus, tend to block more severely than higher density polyolefins such as low density polyethylenes, high density polyethylenes and linear low density polyethylenes.

An example of an elastomer that may be used in the present invention is Dow Chemical's AFFINITY KC8852. The AFFINITY KC8852 resin has a density of 0.875 g/cm$^3$ and a melt index of 3.0 g/10 min. as determined by ASTM D1238. The AFFINITY KC8852 is an ethylene-octene copolymer. Another example of an elastomer that may be used is Exxon's EXACT 4049 resin. The EXACT 4049 resin has a density of 0.873 g/cm$^3$ and a melt index of 4.5 g/10 min. as determined by ASTM D1238.

As discussed above, the elastomeric strips 30 of the present invention comprise behenamide. Behenamides are generally defmed by one of the following formulas: $CH_3(CH_2)_{18}CONH_2$ and $CH_3(CH_2)_{20}CONH_2$. An example of behenamide that may be used in making the drawtape of the present invention is marketed by Croda, Inc. as Crodamide BR, refined behenamide.

The elastomeric strips may be made of blends or coextruded materials. For example, the elastomeric strips may include an elastomeric material that is blended with other elastomeric materials or non-elastic materials.

The elastomeric strip 30 of the present invention generally comprises at least about 50 wt. % elastomer, typically at least about 75 wt. % elastomer and preferably at least about 90 wt. % elastomer and more preferably at least about 95 wt. % elastomer. The elastomeric strip 30 generally comprises from about 500 ppm to about 20,000 ppm (2.0 wt. %) of behenamide, preferably from about 1,000 ppm to about 5,000 ppm of behenamide and more preferably from about 2,000 ppm to about 4,000 ppm of behenamide.

According to another embodiment, the elastomeric strip 30 comprises an elastomer, behenamide and erucamide. Erucamide is generally considered a slip agent. Slip agents generally act as an internal lubricant by migrating to the surface of the plastic during and immediately after processing to reduce friction and improve slip.

It is contemplated that slip agents other than erucamide may be used in the present invention such as oleamide, glycerol monostearate (GMS), silicone, stearamide or combinations thereof. The slip agents may be a part of a masterbatch that includes a base resin. For example, erucamide may be included with a base resin such as a linear low density polyethylene. The elastomeric strip generally comprises from 0 to about 2,000 ppm and more specifically from about 300 to about 1,000 ppm slip agent.

It is contemplated that anti-blocking agents may be added to the elastomeric strip 30. These anti-blocking agents include materials such as talc, silica, diatomaceous earth or combinations thereof.

It is contemplated that other additives may be used in forming the elastomeric strip. For example, a process aid may be desirable in reducing or eliminating melt fracture or a coloring additive may be added.

The elastomeric strip 30 generally has a thickness from about 0.5 mil to about 100 mils and more specifically from about 1 mil to about 10 mils, and from about 4 mils to about 7 mils. The elastomeric strips 30 of the present invention may be wound on reels for storage.

With respect to a typical drawtape bag embodying the present invention, the body panels 12 and 14 may be made from a wide range of polymeric materials such as linear low density polyethylene, low density polyethylene, high density polyethylene, high molecular weight high density polyethylene, polypropylenes, other polyolefins, polystyrenes or combinations thereof. In addition, the body panels may comprise more than one layer by using, for example, two or more of the above polymers. In a multi-layered body panel, the layers of the body panels may be coextruded. Each body panel generally has a thickness of from about 0.2 mil to about 5 mils and more specifically from about 0.4 mil to about 2 mils.

The drawtape 24 comprises a polymeric material having a high yield strength and low elasticity in the draw direction. These properties mean that when the drawtape 24 is subjected to high stresses in the draw direction, the drawtape 24 substantially maintains its shape and does not stretch from its original length. When some prior art drawtapes are pulled hard to close the bag, the drawtape elongates over most of its length and the area where it is gripped by the hand becomes narrow, or "ropes," and hurts the hand. The polymeric material of the drawtape preferably minimizes this "roping" effect. Suitable polymers include, but are not limited to, high molecular weight density polyethylenes, medium density polyethylenes (MDPEs), linear low density polyethylenes, low density polyethylenes, polyesters, polystyrenes, polypropylenes and combinations thereof The drawtape generally has a thickness from about 1 mil to about 5 mils, where a thicker drawtape is desired for bags intended to carry heavier loads.

It is contemplated that the drawtape of the present invention may be made according to other embodiments. For example, a drawtape system may be comprised of two separate drawtapes. Each of the drawtapes are sealed at opposing side seals of the bags. The drawtapes are typically sealed to the opposing side seals via each of its ends. Each of the drawtapes, after being fully installed in the bag, is exposed via holes that are located in the general center of each drawtape. The holes expose the drawtape portions to be used as a handle.

According to another contemplated embodiment of the present invention, a drawtape bag includes at least one pliable thermoplastic body panel, a pliable drawtape and an elastomeric strip. At least one pliable thermoplastic body panel has a top and bottom portion. At least one body panel forms a hem extending along the top portion opposite of the bottom portion. The hem includes one or more drawtape holes.

According to yet another embodiment, an article or bag comprises at least one pliable thermoplastic body panel and an elastomeric strip. The at least one pliable thermoplastic body panels has a top and bottom portion. The at least one body panel forms a hem extending along the top portion opposite of the bottom portion. The elastomeric strip comprising behenamide and is housed within the hem. The article or bag may be in the form of a diaper, shower cap or a laundry bag. The hem may optionally include one or more holes to assist in manufacturing the article.

Methods of Manufacture

Figure 6:
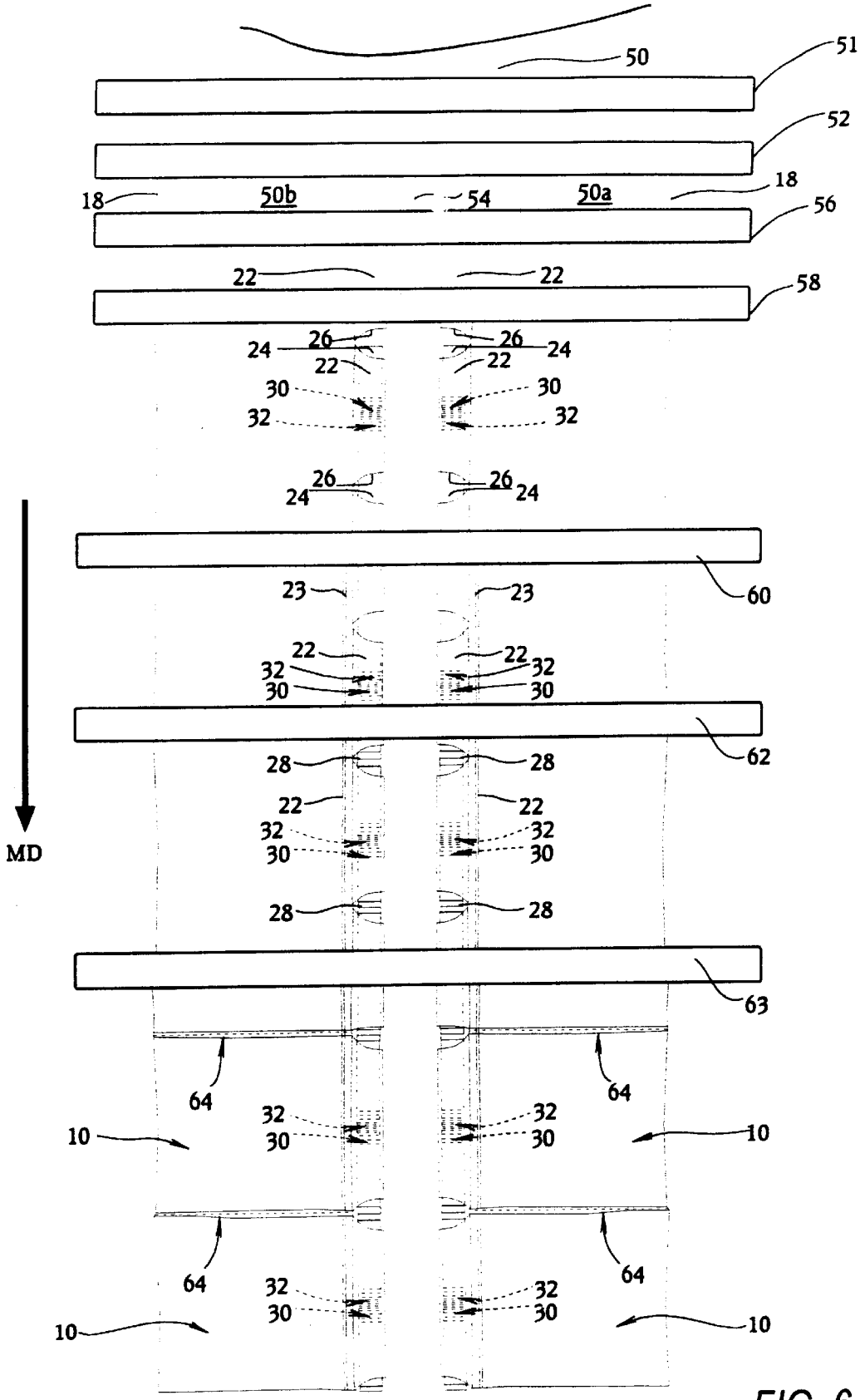
FIG. 6 is a schematic view of a method of manufacturing the drawtape bag.

FIG. 6 is a schematic view of a method of manufacturing drawtape bags 10. First, a thermoplastic tube 50 is extruded in a machine direction (MD), flattened by rollers in a flattening mechanism 51, and then slit in half by a static slitting mechanism 52 along a center line 54. Each half 50*a* and 50*b* of the tube 50 includes a pair of pliable thermoplastic sheets joined to each other along a bottom 18 disposed in the machine direction. The machine direction is designated by an arrow labeled MD in FIG. 6. The sheets are separable from each other along a mouth end proximate to center slit line 54 and opposite the bottom 18.

Second, the sheets are passed through a static folding mechanism 56 in the machine direction (MD) to produce a hem 22 on each sheet along the mouth end 20.

Third, a single-hole cutting mechanism 58 creates drawtape holes 26 in the hem 22 on each sheet at regular distance intervals corresponding to a predetermined width of the drawtape bags 10 produced by the manufacturing method. The drawtape holes 26 in the hem 22 on one of the sheets coincide with the respective drawtape holes in the hem on the other of the sheets.

Fourth, a pliable thermoplastic drawtape 24 from a supply roll (not shown) is continuously fed and inserted into the hem 22 on each sheet. The drawtape 24 has gathered sections 32 disposed at regular distance intervals along the drawtape 24 corresponding to the predetermined width of the drawtape bags 10 produced by the manufacturing method. Prior to insertion, elastomeric strips 30 with behenamide are attached to the respective gathered sections 32 of the drawtape 24 as described above in connection with FIGS. 1–5.

Fifth, a static heat sealing mechanism 60 generates a hem seal 23 in the machine direction (MD) which attaches the hem 22 on each sheet to the respective sheet.

Sixth, a heat sealing mechanism 62 generates drawtape seals 28 which attach the drawtape 24 housed within the hem 22 on the one of the sheets to the drawtape housed within the hem on the other of the sheets at the locations of the coinciding drawtape holes 26. These drawtape seals 28 are transverse to the machine direction (MD). The heat sealing mechanism 62 also creates the anchor seal 38 (see FIG. 1).

Seventh, a heat sealing and perforation mechanism 63 generates side seal structures 64 transverse to the machine direction (MD) and disposed at regular distance intervals corresponding to the predetermined width of the drawtape bags 10 produced by the manufacturing method. Each side seal structure 64 includes a perforation line disposed between a pair of spaced seal lines. The perforation line allows the sheets to be separated into the individual drawtape bags 10. The bags 10 may then be packaged in a dispensing box for sale to consumers.

EXAMPLES

Various strip compositions were made and tested with the results shown in the Table below. Strips 1–5, with various compositions, are shown in the Table. Strips 1–5 were tested for peel forces (elastomeric strip to elastomeric strip and elastomeric strip to a polyethylene ("PB") film). As shown in the Table, Strips 1–5 were comprised of various amounts of elastomer, talc, behenamide, glycerol monostearate (GMS) and erucamide.

Strips 1–5 were all prepared from a single extruder with a screw diameter of 1.25 inch using the same processes. Atfter Strips 1–5 were made, Strips 1–5 were then maintained at a temperature of 140° F. in an oven for seven days. After this time duration, each of the Strips 1–5 was tested using a peel force test procedure. A Kayness Block/ieblock test was not performed because the Strips 1–5 were too small to use the Kayness to measure blocking force. The procedure for the peel force test used is described as follows.

Figure 7:
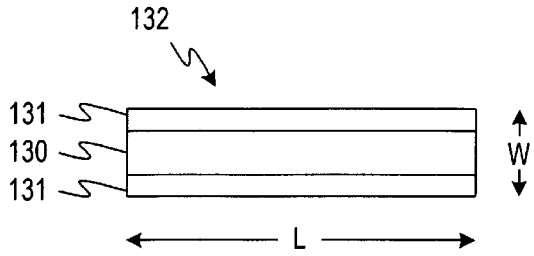
FIG. 7 is a top view of a first sample to be used in a procedure to measure blocking force.
Figure 8:
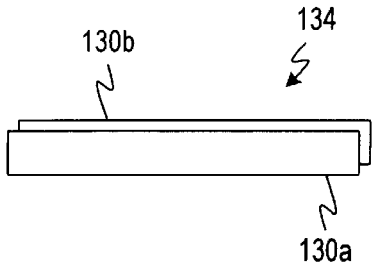
FIG. 8 is an isometric view of a second sample to be used in a procedure to measure blocking force.

Peel Force Test 1. 2 sets of the 5 strips were made. The specific materials for each Strip 1–5 are shown below in the Table.
2. 5 pieces of polyethylene film were cut in the machine direction (MD) to obtain a dimension of 2"×7" (width× length in inches), 12 sheets of blank paper were cut to obtain a dimension of 4"×7", 15 pieces of elastomer strip were cut to obtain a dimension of 0.5"×7".
3. 2 sets of samples were made: Referring to FIG. 7, the $1^{st}$ set placed an elastomeric strip 130 flat on the center of polyethylene film 131. The polyethylene film 131 was obtained from a HEFTY® CinchSak® tall kitchen bag. The combination of the elastomeric strip 130 and the polyethylene film 131 of FIG. 7 is referred to as first set structure 132. The length "L" and the width "W" are indicated in FIG. 7. Referring to the isometric view of FIG. 8, the $2^{nd}$ set placed an elastomer strip 130*a* directly over an elastomeric strip 130*b*. If a top view had been shown, the elastomeric strip 130*b* would not have been visible. The combination of the elastomeric strips 130*a* and 130*b* in FIG. 8 is referred to as second set structure 134.

Figure 9A:
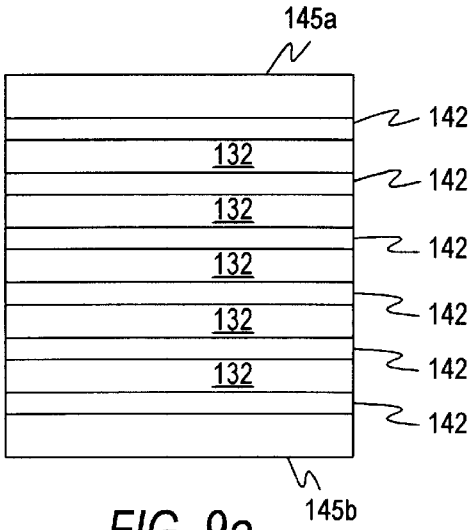
FIG. 9*a* is a side view of a structure including first samples of FIG. 7 between two metal templates in one step of the procedure to measure blocking force.
Figure 9B:
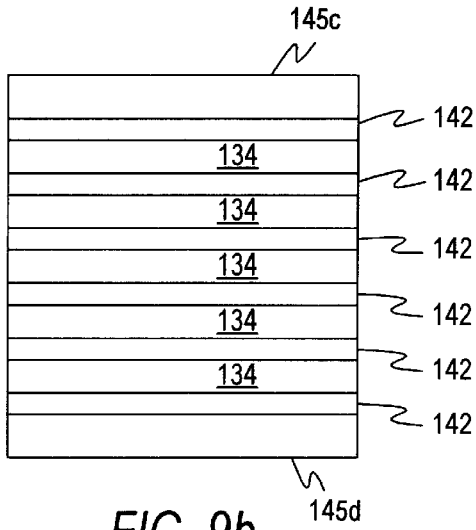
FIG. 9*b* is a side view of a structure including second samples of FIG. 8 between two metal templates in one step of the procedure to measure blocking force.
Figure 10A:
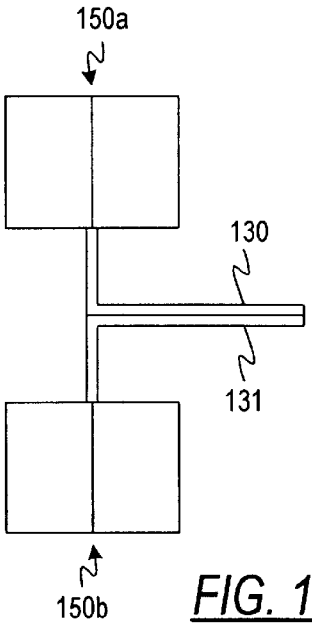
FIG. 10*a* is a side view of the first sample of FIG. 7 between two jaws in another step of the procedure to measure blocking force.
Figure 10B:
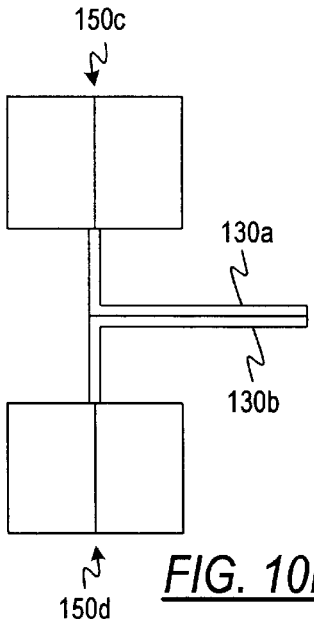
FIG. 10*b* is a side view of the second sample of FIG. 8 between two jaws in another step of the procedure to measure blocking force.

4. Each of the first set structures 132 and the second set structures 134 were conditioned as follows.
5. Referring to FIG. 9*a*, first set structures 132 were placed between 4"×7" sheets of paper 142. The first set structures 132 and the sheets of paper 142 were located between two steel templates 145*a* and 145*b* (4"×7", templates weight of 4 lbs.). The first set structures 132 and the sheets of paper 142 between the steel templates 145*a* and 145*b* were placed in a temperature-controlled oven for 7 days at 140° F.
6. Referring to FIG. 9*b*, second set structures 134 were placed between 4"×7" sheets of paper 142. The second set structures 134 and the sheets of paper 142 were located between two steel templates 145*c* and 145*d* (4"×7", templates weight of 4 lbs.). The second set structures 134 and the sheets of paper 142 between the steel templates 145*a* and 145*b* were placed in the temperature-controlled oven for 7 days at 140° F.
7. The first and second set structures 132 and 134, sheets of papers 142 and steel templates 145*a–d* were removed from the oven and cooled to room temperature. The cooling period was approximately 2 hours. The steel templates 145*a–d* and the sheets of paper 142 were removed from the structures 132 and 134.
8. Referring to FIG. 10*a*, the elastomeric strip 130 was manually peeled back (about 2.5") from the polyethylene film 131 and placed between jaws 150*a* and 150*b* of a tensile tester. The elastomeric strip 130 and the polyethylene film 131 had no slack between the jaws 150*a* and 150*b*. Similarly, in FIG. 10*b*, the elastomeric strip 130*a* was manually peeled back (about 2.5") from the elastomeric strip 130*b* and placed between jaws 150*c* and 150*d* of a tensile tester with no slack.
9. The tensile tester was used in determining the peel force. The tensile tester included a set 2-in jaw separation, 20-in/min. cross head speed, 2.5-in jaw travel (jaws travel on y-axis).
10. The peel test was operated by pulling apart the elastomeric strip 130 from the polyethylene strips 131 and the elastomeric strip 130*a* from the elastomeric strip 130*b*. The peak loads (or peel forces) were recorded. The results of the peel force tests for Strips 1–5 are shown below in the Table.

TABLE

| Strip No. | Elastomer[1] | Talc[2] (ppm) | Behenamide[3] (ppm) | GMS[4] (ppm) | Erucamide[5] (ppm) | Peel Force strip-strip (gram) | Peel Force strip-PE film (gram) |
|---|---|---|---|---|---|---|---|
| 1 | Pure yes | 0 | 0 | 0 | 0 | 34.91 | 25.48 |
| 2 | Pure yes | 0 | 0 | 4000 | 600 | 41.44 | 32.72 |
| 3 | Pure yes | 6000 | 0 | 0 | 600 | 37.71 | 34.45 |
| 4 | Pure yes | 0 | 3000 | 0 | 0 | 4.2 | 5.3 |
| 5 | Pure yes | 0 | 3000 | 0 | 600 | 0 | 0 |

[1]The elastomer used was AFFINITY KC8852 (ethylene-octene copolymer).
[2]The talc used was ABC-5000 PB (50% talc concentrate with a base of LDPE).
[3]The behenamide used was $C_{22}H_{45}NO$ from Croda, Inc.
[4]Glycerol monostearate (GMS).
[5]The erucamide had a chemical formula of $C_{21}H_{41}CONH_2$ and was manufactured by Akzo Nobel Polymer Chemicals, LLC under the name of ARMOSLIP E-N.

Referring to the Table, Strips 4–5 (comprising at least the elastomer and the behenamide) surprising exhibited a very low value in the strip to strip peel force test and the strip to polyethylene (PE) film peel force test. Strips 1–3, without the behenamide exhibited much higher and undesirable values in both peel force tests. It was surprising that the addition of glycerol monostearate (GMS) and erucamide (Strip 2) and the addition of talc and erucamide (Strip 3) not only did not improve the peel force values, but rather increased those values. (Compare peel forces of the elastomer only Strip 1 with Strips 2 and 3).

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A drawtape bag comprising:

a pair of pliable thermoplastic body panels joined to each other along a pair of opposing sides and a bottom bridging the opposing sides, at least one of the body panels forming a hem extending along a mouth end disposed opposite the bottom, the hem including one or more drawtape holes;

a pliable drawtape housed within the hem, the drawtape including a gathered section, the drawtape being partially exposed by the drawtape holes which allow the drawtape to be pulled therethrough to close the bag and to be used as a handle; and an elastomeric strip connected to the gathered section of the drawtape, the elastomeric strip comprising from about 2,000 to about 20,000 ppm behenamide.

2. The drawtape bag of claim 1, wherein the elastomeric strip further comprises erucamide.

3. The drawtape bag of claim 1, wherein the elastomeric strip comprises at least about 50 wt. % elastomeric resin.

4. The drawtape bag of claim 3, wherein the elastomeric strip comprises at least about 75 wt. % elastomeric resin.

5. The drawtape bag of claim 4, wherein the elastomeric strip comprises at least about 90 wt. % elastomeric resin.

6. The drawtape bag of claim 5, wherein the elastomeric strip comprises at least about 95 wt. % elastomeric resin.

7. The drawtape bag of claim 1, wherein the elastomeric strip comprises from about 2,000 ppm to about 5,000 ppm behenamide.

8. The drawtape bag of claim 1, wherein the gathered portion includes one or more loops defining a series of crests and troughs.

9. The drawtape bag of claim 1, wherein the elastormeric strip has an elasticity greater than that of the drawtape and a yield strength less than that of the drawtape.

10. The drawtape bag of claim 1, wherein the elastomeric strip has a total length less than length of the drawtape.

11. The drawtape bag of claim 1, wherein the elastomeric strip is comprised of elastomeric polyethylene and behenamide.

12. The drawtape bag of claim 1, wherein the drawtape is comprised of a polymeric material selected from the group consisting of high molecular weight density polyethylenes, medium density polyethylenes, linear low density polyethylenes, low density polyethylenes, polyesters, polystyrenes, polypropylenes and combinations thereof.

13. A drawtape bag comnprising:

a pair of pliable thermoplastic body panels joined to each other alone a pair of opposing sides and a bottom bridging the opposing sides, the body panels forming respective hems extending along a mouth end disposed opposite the bottom, each of the hems including one or more drawtape holes;

a pair of pliable drawtapes housed within the respective hems, each of the drawtapes including a gathered section, each of the drawtapes being partially exposed by the respective drawtape holes which allow the respective drawtape to be pulled therethrough to close the bag and to be used as a handle; and a pair of elastomeric strips connected to the gathered sections of the respective drawtapes, each of the elastomeric strips comprising from about 2,000 to about 20,000 ppm behenamide.

14. The drawtape bag of claim 13, wherein the drawtape holes in each of the respective hems are located at the opposing sides, the drawtape holes in the hem on one of the body panels generally coinciding with the respective drawtape holes in the hem on the other of the body panels.

15. The drawtape bag of claim 14, wherein the drawtapes are sealed to each other at a pair of drawtape seals coinciding with the drawtape holes.

16. The drawtape bag of claim 15, wherein the hems are sealed to the respective body panels along respective hem seals extending along the mouth end of the bag.

17. The drawtape bag of claim 16, wherein the hems, the pair of elastomeric strips, and the gathered section of each drawtape are sealed to each other at anchor seals.

18. The drawtape bag of claim 13, wherein the pair of pliable drawtapes housed within the respective hems are sealed at opposing side seals of the bags.

19. The drawtape bag of claim 13, wherein the pair of elastomeric strips further comprise erucamide.

20. The drawtape bag of claim 13, wherein the pair of elastomeric strips comprise at least about 50 wt. % elastomeric resin.

21. The drawtape bag of claim 20, wherein the pair of elastomeric strips comprise at least about 75 wt. % elastomeric resin.

22. The drawtape bag of claim 21, wherein the pair of elastomeric strips comprise at least about 90 wt. % elastomeric resin.

23. The drawtape bag of claim 22, wherein the pair of elastomeric strips comprise at least about 95 wt. % elastomeric resin.

24. The drawtape bag of claim 13, wherein the pair of elastomeric strips comprise from about 2,000 ppm to about 5,000 ppm behenamide.

25. A drawtape bag comprising:

at least one pliable thermoplastic body panel having a top and bottom portion, the at least one body panel forming a hem extending along the top portion opposite of the bottom portion, the hem including one or more drawtape holes;

a pliable drawtape housed within the hem, the drawtape including a gathered section, the drawtape being partially exposed by the drawtape holes which allow the drawtape to be pulled therethrough to close the bag and to be used as a handle; and an elastomeric strip connected to the gathered section of the drawtape, the elastomeric strip comprising from about 2,000 to about 20,000 ppm behenamide.

26. The drawtape bag of claim 25, wherein the elastomeric strip further comprises erucamide.

27. The drawtape bag of claim 25, wherein the elastormeric strip comprises at least about 50 wt. % elastomeric resin.

28. The drawtape bag of claim 27, wherein the elastomeric strip comprises at least about 75 wt. % elastomeric resin.

29. The drawtape bag of claim 28, wherein the elastomeric strip comprises at least about 90 wt. % elastomeric resin.

30. The drawtape bag of claim 29, wherein the elastomeric strip comprises at least about 95 wt. % elastomeric resin.

31. The drawtape bag of claim 25, wherein the elastomeric strip comprises from about 2,000 to about 5,000 ppm behenamide.

32. An article comprising at least one pliable thermoplastic body panel having a top and bottom portion, the at least one body panel forming a hem extending along the top portion opposite of the bottom portion, and an elastomeric strip comprising from about 2,000 to about 20,000 ppm behenamide, the elastomeric strip housed within the hem.

33. The article of claim 32, wherein the hems includes one or more holes to assist in manufacturing the article.

34. The article of claim 32, wherein the elastomeric strip further comprises erucamide.

35. The article of claim 32, wherein the elastomeric strip comprises at least about 50 wt. % elastomeric resin.

36. The article of claim 35, wherein the elastomeric strip comprises at least about 75 wt. % elastomeric resin.

37. The article of claim 36, wherein the elastomeric strip comprises at least about 90 wt. % elastomeric resin.

38. The article of claim 37, wherein the elastomeric strip comprises at least about 95 wt. % elastomeric resin.

39. The article of claim 38, wherein the elastomeric strip comprises from about 2,000 to about 5,000 ppm behenamide.

40. The article of claim 32, wherein the bag article is a diaper, shower cap or a laundry bag.

41. The drawtape bag of claim 7, wherein the elastomeric strip comprises from about 2,000 ppm to about 4,000 ppm behenamide.

42. The drawtape bag of claim 7, wherein the elastomeric strip comprises from about 3,000 ppm to about 5,000 ppm behenamide.

43. The drawtape bags of claim 24, wherein the elastomeric strip comprises from about 2,000 ppm to about 4,000 ppm behenamide.

44. The drawtape bag of claim 24, wherein the elastomeric strip comprises from about 3,000 ppm to about 5,000 ppm behenamide.

45. The drawtape bag of claim 31, wherein the elastomeric strip comprises from about 2,000 ppm to about 4,000 ppm behenamide.

46. The drawtape bag of claim 31, wherein the elastomeric strip comprises from about 3,000 ppm to about 5,000 ppm behenamide.

47. The article of claim 39, wherein the elastomeric strip comprises from about 2,000 ppm to about 4,000 ppm behenamide.

48. The article of claim 39, wherein the elastomeric strip comprises from about 3,000 ppm to about 5,000 ppm behenamide.

* * * * *

UNITED STATES PATENT AND TRADEMARK OFFICE

CERTIFICATE OF CORRECTION

PATENT NO. : 6,402,377 B1
DATED : June 11, 2002
INVENTOR(S) : Tin T. Vo et al.

It is certified that error appears in the above-identified patent and that said Letters Patent is hereby corrected as shown below:

Column 11,
Line 11, after the word "other", please replace the word "alone" with the word -- along --.

Signed and Sealed this

Fifteenth Day of October, 2002

*Attest:*

*Attesting Officer*

JAMES E. ROGAN
*Director of the United States Patent and Trademark Office*